United States Patent [19]

Clemens

[11] 4,442,557

[45] Apr. 17, 1984

[54] CARRIER APPARATUS FOR FIRE FIGHTERS

[76] Inventor: Robert M. Clemens, 3700 Sellman Rd., Beltsville, Md. 20705

[21] Appl. No.: 345,674

[22] Filed: Feb. 4, 1982

Related U.S. Application Data

[63] Continuation of Ser. No. 147,211, May 6, 1980, abandoned.

[51] Int. Cl.[3] ..... A61G 1/00; B65D 75/00

[52] U.S. Cl. ..... 5/82 R; 224/158; 294/140; 294/152; 280/19

[58] Field of Search ..... 5/82 R, 82 B; 280/19; 224/158; 294/140, 149, 150, 151, 152

[56] References Cited

U.S. PATENT DOCUMENTS

| | | | |
|---|---|---|---|
| D. 138,791 | 9/1944 | Horckitz | 294/140 |
| 722,456 | 3/1903 | Reeves | 5/82 |
| 982,376 | 1/1911 | MacFarlane | 224/158 |
| 1,328,832 | 1/1920 | Hanrath | 294/140 |
| 3,684,305 | 3/1972 | Ersek | 5/82 R |
| 4,119,250 | 10/1978 | Brutlab | 294/149 |
| 4,124,908 | 11/1978 | Burns et al. | 5/82 R |
| 4,173,351 | 11/1979 | Hetland | 280/19 |
| 4,209,116 | 6/1980 | Hendricks | 294/152 |

*Primary Examiner*—Alexander Grosz
*Attorney, Agent, or Firm*—Irvin A. Lavine

[57] ABSTRACT

A carrier apparatus for use by fire fighters to carry fire hose, and to serve as a personnel carrier; a carrier body of flaccid material about five feet long has a bottom and side walls, and at one end there is an end wall, and portions of the side walls adjacent the end wall being perpendicular to the bottom and end wall. Handles and securing straps are provided. A continuous length of fire hose is placed in two side by side stacks, with a connecting portion from one stack to the other; a strap with hook and pile type fastener, such as sold under the trademark Velcro fastener extends around one stack and is released by force applied through the connecting portion of the fire hose.

5 Claims, 5 Drawing Figures

CARRIER APPARATUS FOR FIRE FIGHTERS

This is a continuation of application Ser. No. 147,211 filed May 6, 1980, now abandoned.

BACKGROUND OF THE INVENTION

The present invention relates to a carrier apparatus for use by fire fighter both as a carrier for fire hose and as a carrier for a person.

It is often necessary for a fire fighter to carry a length of hose with him from the fire truck to a distant location, were the hose will be put in use. For example, where a fire occurs in a high-rise building, shopping mall, large department store, in subway stations and in parking garages, it is necessay to carry the hose into the structure, and to then connect it to a stand pipe, and to deploy it so that water may be directed at the fire. Other instances were the carrying of a fire hose are required are where the fire occurs in a rural location, and it is necessary to transport the fire hose to a suitable source of water, such as a pool, stream or pond.

It is highly desireable that minimum time be consumed between the arrival at the site of the fire by the firemen and the discharging of water on the fire, and so the fire hose must be readily carried, and a suitable length must be carried by a single fire fighter in many instances. Further, it is necessary that the hose be paid-out rapidly, and without requiring the handling of the hose at the carrier by a second fire fighter, while one fire fighter is moving with the nozzle, connected to the fire hose, towards the fire.

Among the problems which face firemen in fighting fires is the necessity for removing victims from the site of the fire, and the most facile way of handling this problem has been the calling for a stretcher by the fireman who has located the victim. This is often time consuming, especially where the fire is at a remote location from the fire engine on which the stretcher is stored, thereby necessitating an additional trip for a hard-pressed fire fighter from the fire site to the fire engine to procure the stretcher or the delay incurred while a separate part of the fire fighting crew is directed to bring a stretcher to the site were the victim is located.

There has been provided in the prior art a hose pack in the form of a container of vinyl coated nylon, the container having a bottom, side walls, end walls, and two flaps which could be secured together along their edges, as by zipper, to form a top wall. This hose pack had a length of approximately twenty nine inches, a width of approximately eighteen inches, and height of approximately six inches. Carrying handles were provided, and this hose pack carried a length of hose provided in two layers, each fan-folded. The bottom layer was continuous, and the top layer was in two portions, each also fan-folded, with the terminals of the fire hose being provided with a connector or union and a nozzle, the connector or union and the nozzle being at the center of the top layer. This construction could not be used for carrying a victim from the site of the fire.

Matsuyama et al. No. 3,942,636 discloses a carrier for a single fan-folded stack of file hose which is in the form of a rectangle, and encircles the stack, being secured by suitable straps. This construction carries a very limited length of fire hose, and is not suitable for use as a carrier for a person.

SUMMARY OF THE INVENTION

A carrier is provided, and includes a carrier body of flaccid material, having a length sufficient to carry an adult victim, without being unduly long. Preferably, the length of the carrier body will be sufficient to support the head, trunk thighs and a portion of the lower legs of a person of a height of approximately six feet, the carrier body thereby having a length of approximately five feet. The carrier body includes a bottom, a pair of side walls, and an end wall. The portions of the side walls adjacent the end wall are perpendicular to the bottom and to the end wall. A pair of handles are provided on each side wall, one pair being located near the end wall and the other pair being located remote from the end wall. Straps are provided, extending from one end wall to the other, being remote from the bottom.

Within the carrier body there is provided a continuous length of fire hose, which is positioned in two stacks, side by side, with a connecting portion extending from the bottom of one stack to the top of the other stack. One of the stacks is provided with an encircling strap, near its mid point, and on the ends of this strap there are provided hook and pile fastener pads. The ends of the strap which are provided with the Velcro are at the top of the second stack, the connecting portion of the fire hose engages the end of the encircling strap which is on top, so that when the fire hose is paid out, the force of the connecting portion applied to the end of the encircling strap which is on top will cause it to be lifted from and to thereby by disengaged from the pad on the other end of the strap, so as to automatically release the securing of the encircling strap.

Among the objects of the present invention, therefore, are the provision of a carrier which will be useful both as a carrier for fire hose, and as a carrier for fire victim. Another object of the present invention is to provide a carrier and a fire hose package which is readily carried by a single fire fighter, which may be stood on its end and then lifted readily from said position, and another object is to provide a construction in which the fire hose may be paid out or deployed with great rapidity. A still further object of the present invention is to provide a carrier and hose package construction which will hold the hose securely, but which may be readily released, and which is, in part, self-releasing.

Other objects and many of the advantages of the present invention will be readily understood from the following description, claims and drawings.

DESCRIPTION OF THE PREFERRED EMBODIMENT

Figure 1:
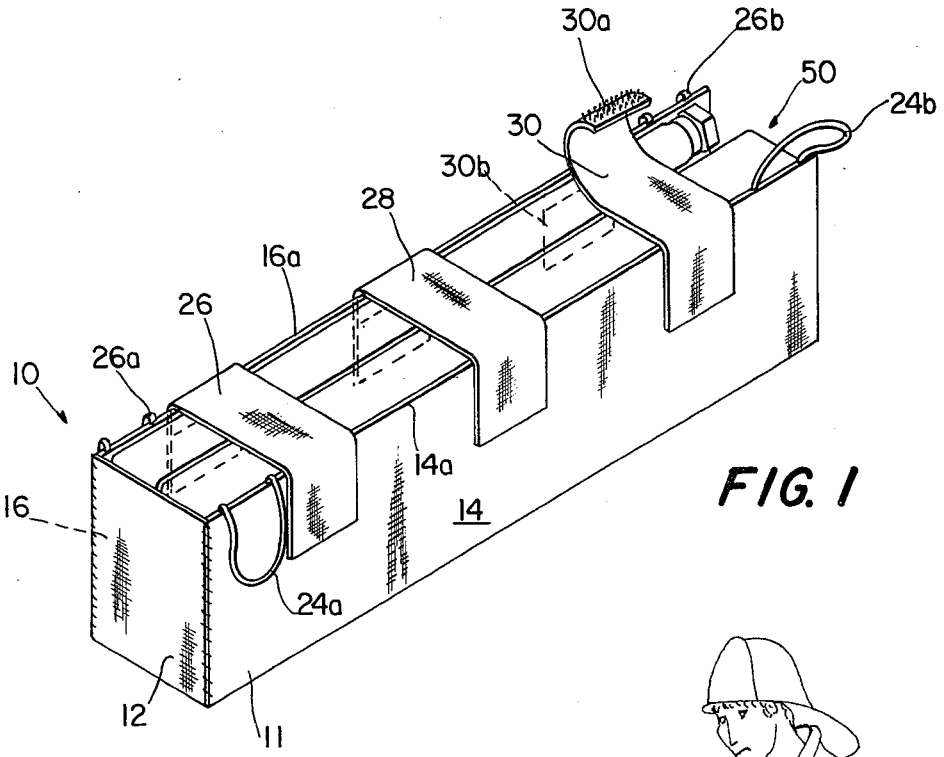
FIG. 1 is a perspective view of a carrier and hose in accordance with the present invention.

Referring now to the drawings, wherein like or corresponding reference numerals are used to designate like or corresponding parts throughout the several views, there is shown in FIG. 1 a carrier apparatus 10 which comprises an elongate carrier body 11 which is made of suitable flaccid material. Such material is strong, abrasion-resistant, and water impervious. Various materials of suitable character are known, and these include Nylon, or fabric impregnated with Nylon, and materials having various coatings. At the left end of the carrier body 11 there is provided an end wall 12, and there may be seen, also, a side wall 14. Opposite side wall 14, and generally parallel to it, is a side wall 16. The side walls 14 and 16, at the portions thereof adjacent the end wall 12, are substantially perpendicular to end wall 12, and they are also perpendicular to the bottom (not shown in FIG. 1).

Remote from the bottom, the side wall 14 has a free edge 14*a*, and parallel thereto there is the free edge 16*a* of the side wall 16. The carrier body 11 will be seen to be open at the top, between the edges 14*a* and 16*a*, and is also open at the end opposite end wall 12. The side wall 14 is provided with a pair of handles 24*a* and 24*b*, and there are corresponding handles 26*a* and 26*b* on the side wall 16. Only a portion of the latter handle is shown, but it will be understood that each of the handles is substantially identical, and is in the form of a loop, portions of which are suitably secured to the noted side walls.

Extending across the open space between the side walls 14 and 16, remote from the bottom of the carrier body 11, and transversely of the edges 14*a* and 16*a*, are securing straps 26, 28 and 30. These straps are each securely attached at one end to the side wall 14, and have, at their opposite ends, a pad of fastening material, such as pad 30*a* shown in FIG. 1. A corresponding pad 30*b* is shown in dotted lines on side wall 16, and corresponding pads are provided for the straps 26 and 28.

Within the carrier body 11 there is provided a length of fire hose 50, which is positioned in two fan-fold stacks, placed side by side, fire hose 50 being continuous.

The length of the carrier body 11 is provided such that it is at least equal to the major portion of the length of the body of an adult. More particularly, the length of the carrier body 11 is provided so that an adult of, for example, six feet or more in height, will have his head, body, upper legs and the lower legs as far as the calves, supported, when placed in or on the carrier body 11 with his head adjacent the end wall 12.

Figure 2:
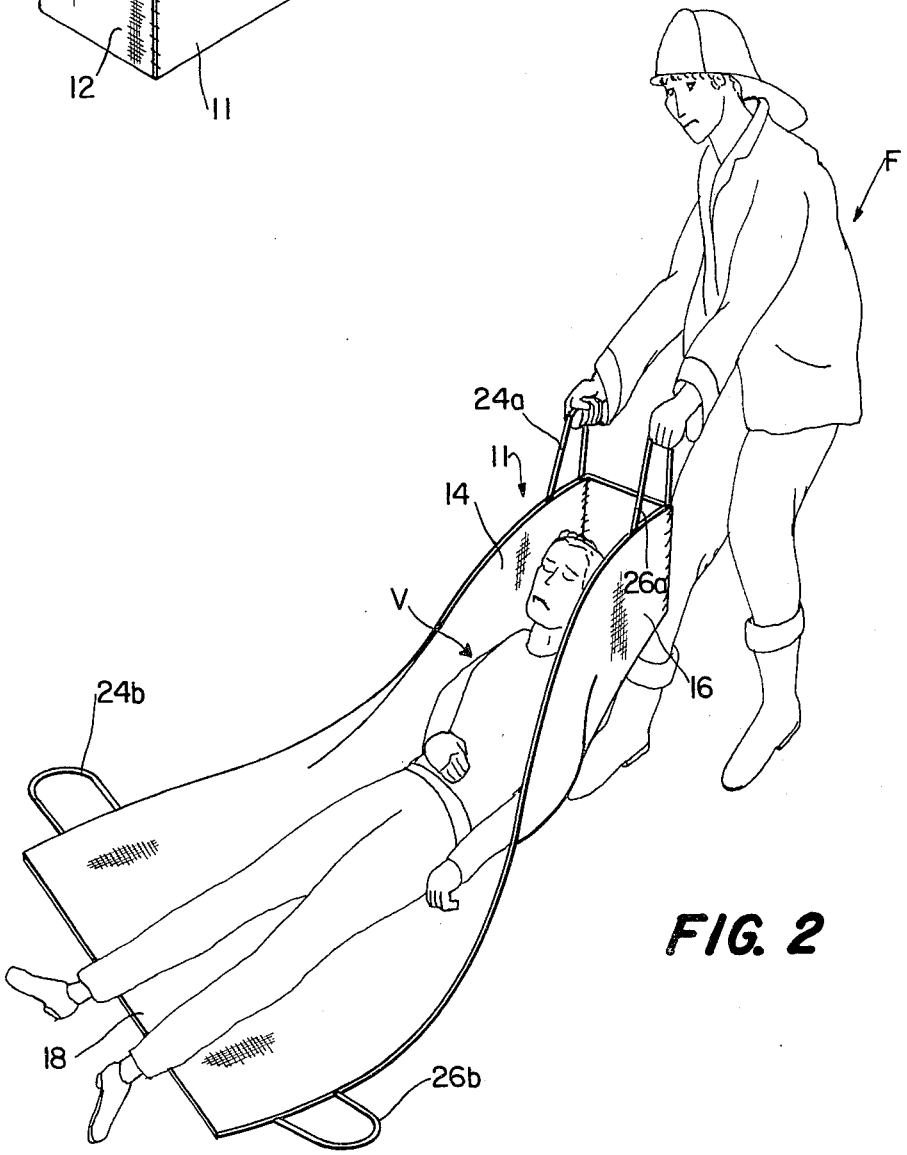
FIG. 2 is a perspective view showing the use of the carrier as a person transporter.

Referring now to FIG. 2, there is shown the carrier body 11 being used as a device to remove a victim from the scene of a fire. As is clearly shown, the victim V is positioned so that his back is against the back 18 of the carrier body 11, and with his head substantially adjacent to end wall 12. If there is only one fire fighter F available, the victim may be dragged from the place of danger, by the fire fighter F pulling on the handles 24*a* and 26*a* which are located adjacent the end of carrier body 11 at which the end wall 12 is located. The end wall 12 has a width, in practice, of approximately seven inches, so that the portions of the side walls 14 and 16 which are adjacent the end wall 12 will be spaced that same distance, and thereby tend to cradle or cushion the head of the victim V between them. It will be noted that the length of the carrier body 11 is such that it will underlie almost the entire length of the victim V, terminating approximately at the calves of the victim V.

The bottom 18 is preferably padded, so as to cushion the victim, and the padding of the bottom 18 also serves to make more comfortable the carrying of the apparatus 10, as shown in FIG. 1, when it is necessary for the fireman to place it on his shoulder and to carry it. The height of end wall 12 and the side walls 14 and 16 are such as to accomodate a substantial length of fire hose 50, and in practice, this height is preferably ten inches.

As will be understood, while the carrier body 11 is entirely suitable for use to transport a victim where there is only one fireman available, it is preferred to transport the victim by two, or even four, firemen, if such additional firemen are available. In that case, use will be made of the handles 24*b* and 26*b*, so that the victim is not dragged, but is lifted, and while a portion of the legs of the victim will extend beyond the end of the carrier body 11, the lower end of the legs will be substantially in line with the thighs of the legs, and will not hang down, since the lower portions of the legs of the victim will be supported at least to approximately the calves of the legs.

When the carrier apparatus 10 is to be transported by a fireman from the fire truck, it may be placed on the shoulder of a single fireman, some comfort being provided by the padding of the bottom 18. On the other hand, two or more fireman may carry the carrier apparatus by the handles thereof. In instances where the carrier apparatus must be carried into an elevator, it may be so carried and then stood on the end wall 12. The carrier apparatus is sufficiently rigid that it will not collapse, or fall over, it steadied by the fire fighter. Also, it is highly advantageous to have a carrier apparatus 10 of the present invention, which will take up a minimum of floor space, in this case, a space of only seven inches by ten inches. Since the carrier has a height of approximately five feet, the fireman may pick up the vertical-standing carrier apparatus 10 with one hand, thereby affording great advantage when, as often happens, the fireman is carrying other equipment with the other hand.

Figure 3:
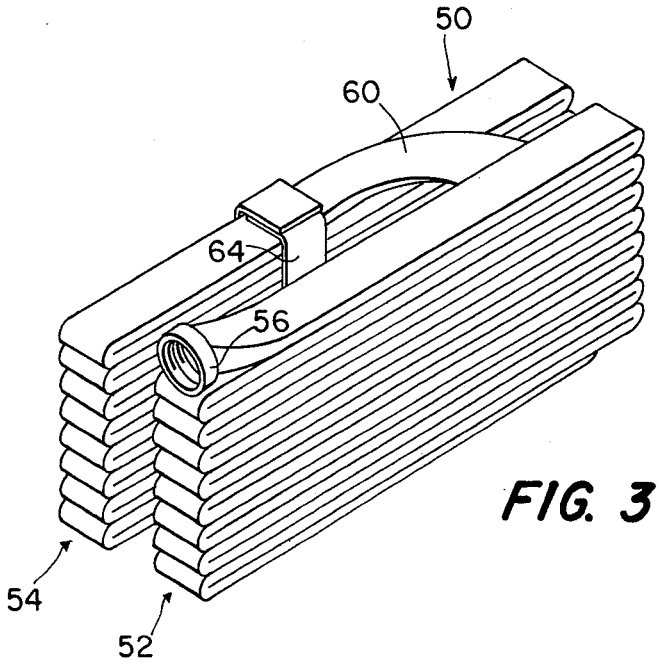
FIG. 3 is a perspective view of the arrangement of the fire hose, with stacks displaced for clarity.
Figure 4:
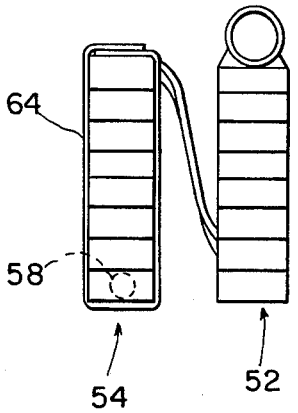
FIG. 4 is an end view of the structure shown in FIG. 3.

Referring now to FIG. 3, there is shown the fire hose 50, which is provided in a first stack 52 and a second 54. In each of these stacks 52 and 54, the fire hose 50 is fan-folded, or zig-zag folded. Each stack has a terminal, and as shown in FIG. 3, the terminal of the stack 52 is provided by a connection or union 56. In FIG. 4, there is shown in dotted lines a nozzle 58 which is provided in the stack 54. A connecting portion 60 extends from the bottom of the stack 52 to the top of the stack 54. In FIGS. 3 and 4, the stacks 52 and 54 are shown in spaced apart relationship for purposes of illustration, but in practice it will be understood that they are, in the carrier body 11, in adjacent, substantially contacting relationship, as shown in FIG. 1.

A strap 64 encircles the second stack 54 in order to hold it in assembled condition.

Figure 5:
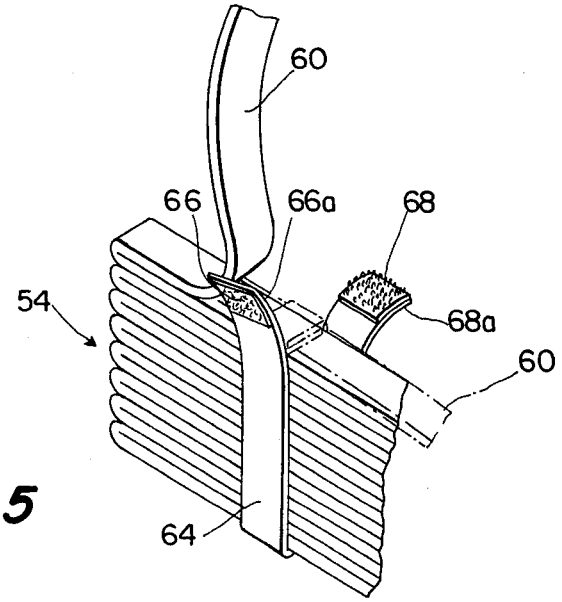
FIG. 5 is a view showing the automatic release of a securing strap by forces applied directly to the fire hose.

Referring now to FIG. 5, which is a perspective view of the stack 54 taken from the end opposite that which is adjacent the connector 56, and with the stack 52 having been paid out or deployed, it will be understood that there will remain only the stack 54, which is partially disclosed. The enircling strap 64 has an end portion 66, on the underside of which is fastening pad 66*a*, and the strap 64 has another end portion 68, on the upper surface of which is a cooperating fastening pad 68*a*. As shown in dash lines, the connecting portion 60 extends somewhat at an angle, and is beneath the end portion 66 of the strap 66 adjacent to the fastening pad 66*a*, which in the engaged position, is in contact with the fastening pad 68*a* on the end portion 68. A force on the fire hose 50 would be transmitted to the connecting, portion 60 thereof, and this force would then engage the end portion 66, so as to lift it up from the end portion 68. This action thereby serves to peel the fastening pad 66*a* from engagement with the fastening pad 68*a*, so that the connecting portion thereby serves to automatically release the fastening securing elements of the encircling strap 64, taking a position, for example, as shown in full lines in FIG. 5.

There has been provided a carrier apparatus highly useful as both a carrier for fire hose, and as a carrier for a victim, thereby providing a carrier for a victim at the fire site, without the need for transporting to the fire site an additional piece of equipment. This is highly important, because every man at a fire site is burdened and has many tasks to perform. The carrier body herein provided will enable the transporting of a victim from the fire site either by a single fire fighter, or, if available, a plurality of fire fighters. The victim will be held relatively securely, and is transportated in such a manner as is not likely to injure the victim during transportation from the fire site.

Further, the herein provided carrier apparatus may be transported with some degree of comfort by a single fireman, the carrier apparatus, including the fire hose, being relatively rigid, and of sufficient heigth that it may be picked up by a fireman simply by bending over and having his shoulder engage the approximate mid portion of the carrier apparatus with the fire hose contained therein. At the fire site, opening of the carrier body is readily effected by manipulation of the securing straps thereon, after which the connection to a stand pipe or other source of water may readily be made by one, while another proceeds with the nozzle to the fire site. No attention need be given by any fire fighter to the fire hose 50 after the straps of the carrier body are loosened, since the strap encircling one of the stacks will be released by the forces acting on the connecting portion of the fire hose extending to the stack which is encircled by the circling strap.

It will be obvious to those skilled in the art that various changes may be made without departing from the spirit of the invention, and therefore the invention is not limited to what is shown in the drawings and described in the specification but only as indicated in the appended claims.

What is claimed is:

1. Carrier apparatus for use by fire fighters for carrying hose to a fire site as a package of a size to contain a substantial length of fire hose and of a weight which may be carried by a single fire fighter, and for use as a person carrier to support supine adult victim for rescue by dragging by a single fire fighter or for lifting by plural fire fighters, comprising, an elongate, flaccid carrier body made of flaccid material, and having a length approximately equal to the distance from the head to the calf of an adult, said carrier body having an elongate bottom, a single end wall and a pair of spaced side wall means for cradling the head of a victim there between, said single end wall being at an end of and substantially perpendicular to said bottom, said carrier body having an open end opposite said single end wall, said side wall means extending from said single end wall, and being subtantially perpendicular to said end wall at their junctions therewith, said side wall means extending from said end wall in the same direction as said bottom, and being spaced apart approximately the width of a head at said end wall, sid side wall means each having a longitudinally extending edge remote from said bottom, and extending to said bottom, handle means on each of said side wall means for lifting said carrier body and a load supported thereby, and comprising:

(a) first handle means adjacent said end wall for lifting the head and upper body portion of the victim on said carrier body and for causing said side wall means to cradle the head of a victim therebetween, and (b) second handle means remote from said first handle means for lifting the lower body of a victim on said carrier body, and strap means extending from one side wall means to the other side wall means across the edge thereof, and releasable securing means for said strap means, whereby a fire hose may be placed in said carrier body with an end of the fire hose placed adjacent the open end of said carrier body for ready withdrawal from said carrier body, and whereby an adult victim may be dragged or carried on said carrier body, with the victim's head adjacent said end wall, supported on said bottom, and cradled between said side wall means.

2. The carrier apparatus of claim 1, wherein said bottom has a length of at least about 54 inches.

3. The carrier apparatus of claim 1, wherein said bottom has a length of about five feet.

4. The carrier apparatus of claim 1, wherein said side wall means are spaced apart at said single end wall a distance of approximately seven inches.

5. The carrier apparatus of claim 1 or 4, wherein said end wall has a height from said bottom of approximately ten inches.

* * * * *